US005556514A

United States Patent [19]

Didier

[11] Patent Number: 5,556,514

[45] Date of Patent: Sep. 17, 1996

[54] EXTENDED NIP PRESS APPARATUS WITH GEARED BLANKET EDGE CLAMP

[75] Inventor: James J. Didier, Beloit, Wis.

[73] Assignee: Beloit Technologies, Inc., Wilmington, Del.

[21] Appl. No.: 451,389

[22] Filed: May 26, 1995

[51] Int. Cl.[6] ..... D21F 3/02

[52] U.S. Cl. ..... 162/358.3; 162/272; 492/22; 492/42

[58] Field of Search ..... 162/358.3, 358.4, 162/272; 492/45, 47, 21, 22, 23, 42

[56] References Cited

U.S. PATENT DOCUMENTS

| | | | |
|---|---|---|---|
| Re. 33,034 | 8/1989 | Schiel et al. | 241/119 |
| 4,625,376 | 12/1986 | Schiel et al. | 29/119 |
| 4,673,461 | 6/1987 | Roerig et al. | 162/205 |
| 4,861,434 | 8/1989 | Bonander et al. | 162/358.3 |
| 4,944,089 | 7/1990 | Flamig et al. | 29/895.2 |
| 4,975,152 | 12/1990 | Filzen et al. | 162/358.3 |
| 5,011,578 | 4/1991 | Lange et al. | 162/358.3 |
| 5,098,523 | 3/1992 | Marinen et al. | 162/358.3 |
| 5,141,601 | 8/1992 | Karlsson et al. | 162/358.3 |
| 5,167,768 | 12/1992 | Cronin et al. | 162/358.3 |

*Primary Examiner*—Karen M. Hastings

*Attorney, Agent, or Firm*—Dirk J. Veneman; Raymond W. Campbell; David J. Archer

[57] ABSTRACT

In an extended nip press employing an endless loop nip blanket the invention is a gear-actuated blanket edge clamp. The ends of the blanket are sealed to rotatably mounted heads and forced against sealing surfaces on the heads by shoes which are mounted radially about the heads. The shoes are pivotally mounted to main pivot links. These in turn are pivotally mounted to the head. A jack link joins each of the main links to an expanding gear ring. The gear ring is rotatably mounted to the head about the axis of the head's rotation. The gear ring has two opposed gear teeth segments. Two opposed pinion gears which are mounted on shafts ride on the geared sections. The shafts are turned from the exterior of the head, and cause the expanding gear ring to rotate. The rotation of the gear ring causes the jack links to press against the main links, causing the main links in turn to swing radially outwardly. The outward displacement of the main links causes the shoes to move outwardly against the clamping surface. A gear clamping ring is disposed inwardly of the gear ring and shoes, and is arranged to secure the shoes and ring gear against movement. During operation of the extended nip press, the blanket is held taut by internal pressure. In an alternative embodiment, the jack links have spring biasing to accommodate variations in link dimensions.

17 Claims, 8 Drawing Sheets

EXTENDED NIP PRESS APPARATUS WITH GEARED BLANKET EDGE CLAMP

FIELD OF THE INVENTION

This invention relates to an extended nip press apparatus for pressing water from a web of paper. More particularly, the present invention relates to an "apple" type enclosed expanded nip press in which lubricant disposed between the press shoe and the blanket is enclosed or contained within the blanket. Still more particularly, the present invention relates to the construction of the blanket end seal in such an apparatus.

BACKGROUND OF THE INVENTION

An extended nip press is a press for papermaking in a papermaking machine which increases the residence time of a web during passage of the web through a pressing nip. Typically, a nip is thought of as the narrow region about the line of co-tangency when two rolls with aligned axes are brought tangent to one another. The nip between rolls has classically been used in papermaking to remove water and to compress the fibers in the paper web into a smooth surface. Within a papermaking machine it has been found to be desirable to increase the area of the nip and so subject the paper web to a somewhat lower pressure, more uniform pressing in which more heat transfer between the roll and the paper can take place. In some circumstances, the nip can be extended by coating the surface of one or both of the rolls with a compliant material. The use of a compliant roller allows for nips somewhat greater than an inch in length along the direction of the web through the nip.

The desire for even longer nips led to the development of the so-called Extended Nip Press (ENP). The ENP employs a backing roll and an elongated shoe which has a concave surface which matches the convex surface of the backing roll and cooperates with the roll over a length on the order of ten inches along the direction of travel of the paper web. The shoe, which forms one-half of the nip, is stationary. Without further modification, a paper web moving through the nip formed between the shoe and the backing roll would experience unacceptable rubbing on the non-moving shoe. To overcome this problem, a bearing blanket forming a cylindrical tube is slidably disposed over the shoe and around the support shaft on which the shoe is mounted. Friction between the bearing blanket and the shoe is greatly reduced due to the presence of an oil film which is supplied between the nip and the backside of the blanket. The blanket thus freely slides on an oil film on the shoe.

To aid in the drying or pressing of the paper web, a felt or blanket often underlies and supports the paper web as it transits the extended nip between the backing roll and the bearing blanket on the shoe. The backing roll, the paper web and the web support blanket, if present, are frictionally engaged and in turn engage the upper surface of the bearing blanket, causing it to slide over the shoe and to rotate about the shoe and its support shaft.

On one type of extended nip press the bearing blanket is tensioned and supported by rolls which result in open ends to the cylindrical blanket. The open end of the bearing blanket causes a problem with oil contamination of the web. There is a tendency for lubricating oil disposed between the shoe and the blanket to creep around the edges of the blanket so that the press felt and the paper web become contaminated.

Further, such oil tends to atomize and subsequently settle as an oily film on ancillary equipment. Such oily film causes a potential hazard in the form of slippery walk ways and access ladders. It also poses a potential fire hazard in that the atomized oil droplets have a relatively low flash point. The solution to this problem has been to seal the ends of the blanket to two rotating heads which are mounted on the shoe support shaft. The edges of the bearing blanket are extended beyond the shoe where they are free to take on a circular cross section which may be sealed or joined to the disc shaped rotating heads.

The cross-section of the blanket at the heads is circular, but the cross-section taken through the nip between the shoe and the backing roll has an appearance somewhat similar to an apple in cross-section. The shape of the blanket is circular, with a concave, dimpled surface where the stem of an apple would be. Thus, as the press blanket moves through the nap, it is elastically deformed. More particularly, between the ends of the nip and the ends of the blanket, the material of the blanket forms a compound curve as the blanket transits from the shape of the nip to the circular ends of the blanket where they are attached to the rotating head assemblies. As a result of the compound curve flexure in the blanket the blanket must be periodically replaced.

A typical papermaking machine of which the extended nip press forms a part may produce over half a million square feet of paper an hour. Thus, down time is costly and the method of clamping the blanket to the rotating head assemblies must be compatible with rapid and precise replacement of the blanket.

What is needed is a blanket-to-head clamping device of improved simplicity and performance.

SUMMARY OF THE INVENTION

The extended nip press apparatus of this invention employs an endless loop nip blanket which employs gear-actuated blanket edge clamps. The extended nip apparatus has a press frame on which a backing roll is mounted for rotation. An elongated shoe defining a concave surface is disposed beneath and opposed to the press roll. The concave surface of the shoe and the opposed surface of the press roll form an extended nip. The nip, which may typically be about ten inches long, forces a paper web into extended and high pressure contact with the press roll. The extended high pressure passage through the nip is advantageously used in presses, impulse dryers, and the like, to speed the removal of water and drying of a paper web in a papermaking machine.

In order to lower the friction between the paper web or its backing felt and the shoe, a lubricated endless blanket is passed over the concave surface of the shoe. The inside surface of the blanket, which rides on the concave surface of the shoe, is lubricated with oil to form a compressed oil film on which the blanket rides. The oil film presents a problem. In the modern, high speed papermaking machine, where the paper web may move at 3,000 feet per minute, the nip blanket will also move at 3,000 feet per minute, and generate a spray of oil droplets on the downstream side of the shoe. These oil droplets, if free to escape from the interior of the blanket, can contaminate the paper web as well as produce a safety and fire hazard.

To seal the interior of the blanket, the ends of the blanket of this invention are sealed to rotatably mounted heads. The heads extend radially about their axis of rotation and have rings which extend along the head's axis of rotation. The inside surfaces of the rings form sealing surfaces which are opposed to and surround a portion of the outside surface of the blanket adjacent to the blanket ends. The ends of the blanket are forced against and sealed to the sealing surfaces of the end rings. The mechanism for forcing the ends of the blanket against the sealing surfaces consists of 24 convex shoes which conform to the sealing surface and which are mounted radially about the axis of rotation of the heads.

The shoes are pivotally mounted to main pivot links which are pivotally mounted to the head. A jack link joins each of the main links to an expending gear ring. The jack links are pivotally mounted to the center of the main links on one end, and on the other are pivotally mounted to the gear ring. The gear ring is rotatively mounted to the head about the axis of the head's rotation. The interior of the gear ring has two opposed gear teeth segments. The gear teeth segments extend approximately two-and-a-half degrees along the circumference of the gear ring and are integrally formed with the gear ring. Two opposed pinion gears ride in the gear sections in driving relation. The pinion gears are mounted on shafts which extend through the head and are accessible on the outside surface of the head. When the shafts are turned from the exterior of the head, they cause the expander gear ring to rotate through approximately two-and-a-half degrees. The rotation of the gear ring causes the jack links to press against the main links, causing the main links in turn to swing radially outward. The outward motion of the main links causes the shoes spaced about the circumference of the head to move outwardly against the clamping surface, thereby clamping the blanket end against the clamping surface. The gear clamp ring is disposed axially and radially inwardly of the clamping ring and shoes, and is arranged so it may be secured by bolts from the outside surface of the head to bring it into clamping engagement with the ring gear, thus holding the shoes in a clamping position.

In an alternative embodiment, the jack links have spring biasing to accommodate variations in link dimensions.

During operation of the extended nip press, the blanket is held taut by internal pressure to prevent fluttering and the like. A one-pound-per-square-inch pressure is used on start-up. At operating speed, centrifugal force also serves to keep the blanket in a radially extended condition and the operating pressure is reduced to by half.

It is an object of the present invention to provide a blanket end seal which decreases the down time associated with replacing the shoe blanket.

It is another object of the present invention to provide a seal for an extended nip blanket which is air and oil tight.

It is yet a further object of the present invention to provide an extended nip blanket which does not require internal guides.

Further objects, features, and advantages of the invention will be apparent from the following detailed description when taken in conjunction with the accompanying drawings.

DESCRIPTION OF THE PREFERRED EMBODIMENT

Referring more particularly to FIGS. 1–14, wherein like numbers refer to similar parts, an extended nip blanket clamp 20 is shown in FIGS. 1–5.

Figure 9:
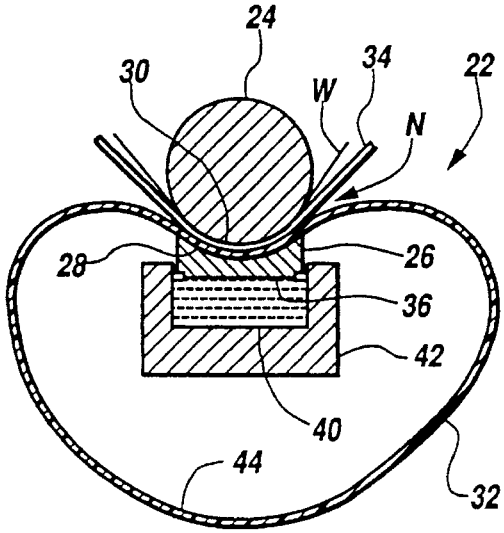
FIG. 9 is a schematic cross-sectional view of a typical extended nip press.

As shown in FIG. 9, an extended nip press 22 has a backing roll 24 which is opposed to a shoe 26. The shoe has a concave surface 28 which conforms to the cylindrical surface 30 of the backing roll 24 and forms a nip N between the backing roll 24 and the shoe 26. A continuous looped blanket 32 extends through the nip N between the roll 24 and the shoe 26. A press felt 34 passes over the blanket 32, and a paper web W is supported on the felt as the blanket 32, felt 34, and web W pass through the nip N. The shoe 26 is supported and urged against the surface 30 of the roll 24 by a hydraulic piston which moves in a piston cavity 40. The piston cavity 40 is formed in a non-rotating support beam 42. The extended nip press 22 shown in FIG. 9 is well known in the papermaking art. It is utilized in the pressing and drying of the paper web in the pressing and drying sections of a papermaking machine.

As shown in FIG. 9, the blanket 32 has a characteristic apple shape caused by its path through the nip N. The passage of the blanket 32 over the concave surface 28 is facilitated by a film of oil (not shown) which supports and lubricates the blanket's passage through the nip N. This lubricating oil tends to escape from the interior 44 of the blanket 32 unless the ends of the blanket 32 are enclosed.

Figure 5:
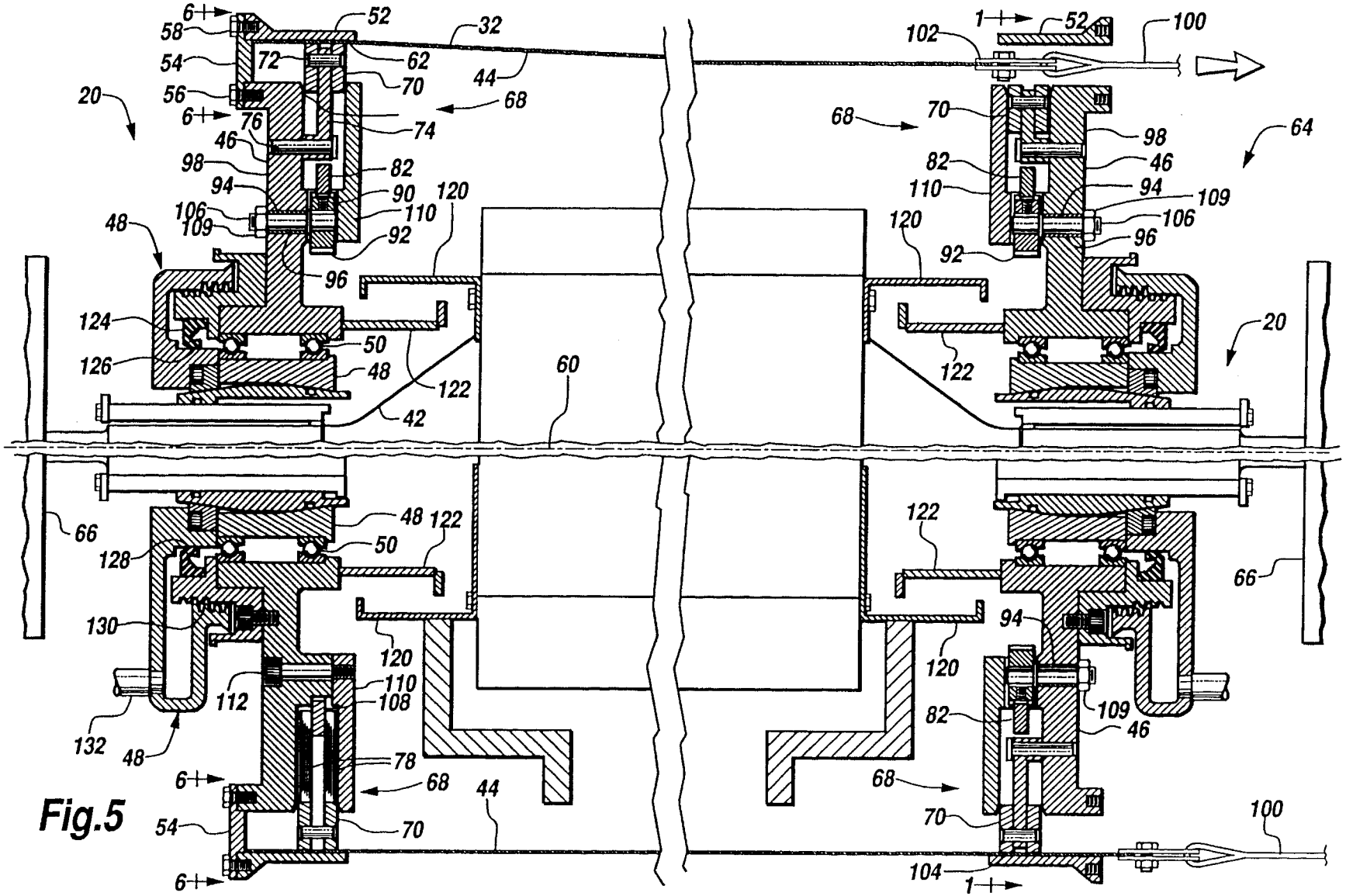
FIG. 5 is a detailed partial cross-sectional view of the extended press nip of this invention.
Figure 6:
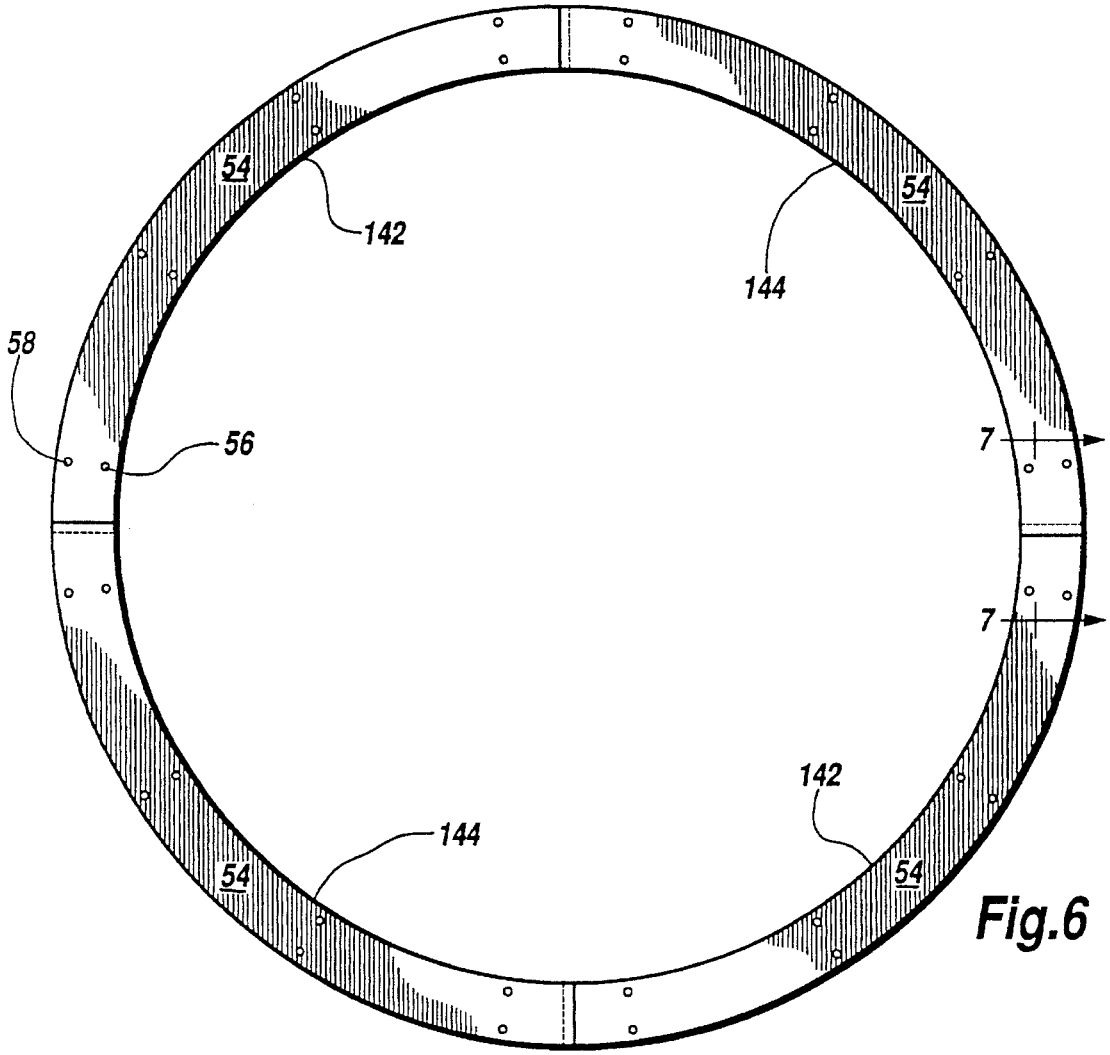
FIG. 6 is a side elevational view of the blanket end covers taken along lines 6—6 of FIG. 5.

The closure of the blanket 32 is simplified by extending it beyond the ends of the backing roll 24 so that it can be made to conform to a circular cross-section and thus be sealed by circular head ends 46, as shown in FIG. 5. The head ends 46 are rotatably mounted on bearings 50 to stationary supports 48. These in turn are mounted to the shoe support beam 42.

In a conventional head-to-blanket end seal, the sealing surface on the head faces radially outwardly. The nip blanket 32 is stretched over the sealing surface and clamped thereto. The problem of such conventional attachment arrangements is the difficulty of passing the blanket 32 over one head in order to position the blanket 32 between the two heads. The blanket clamp assembly or blanket edge clamp assembly 20 overcomes these difficulties in the following manner. As shown in FIG. 5, rings 52 are joined to the end heads 46 by blanket ring end covers 54, best shown in FIG. 6. The rings 52 are generally cylindrical about the axis of the heads. The covers 54 are annular plates which extend generally perpendicular to the rings 52. The ring end covers 54 are bolted to the heads 46 by bolts 56 and to the rings 52 by bolts 58. The ring end covers 54 hold the rings 52 spaced outwardly of the drum end heads 46. The rings 52 extend inwardly between the drum end heads 46 along the axis 60 defined by the rotation of the drum end heads 46. Each ring has a radially inwardly facing surface 62 which forms a sealing surface. The sealing surface 62 extends along the axis 60 and faces inwardly towards the axis 60. The blanket shoe assembly 64, as shown in FIG, 5, consists of two head ends 46 mounted on the support beam 42. The support beam 42 is mounted to the machine frame 66. The support beam 42 supports the shoe 26, which underlies the blanket 32.

Figure 1:
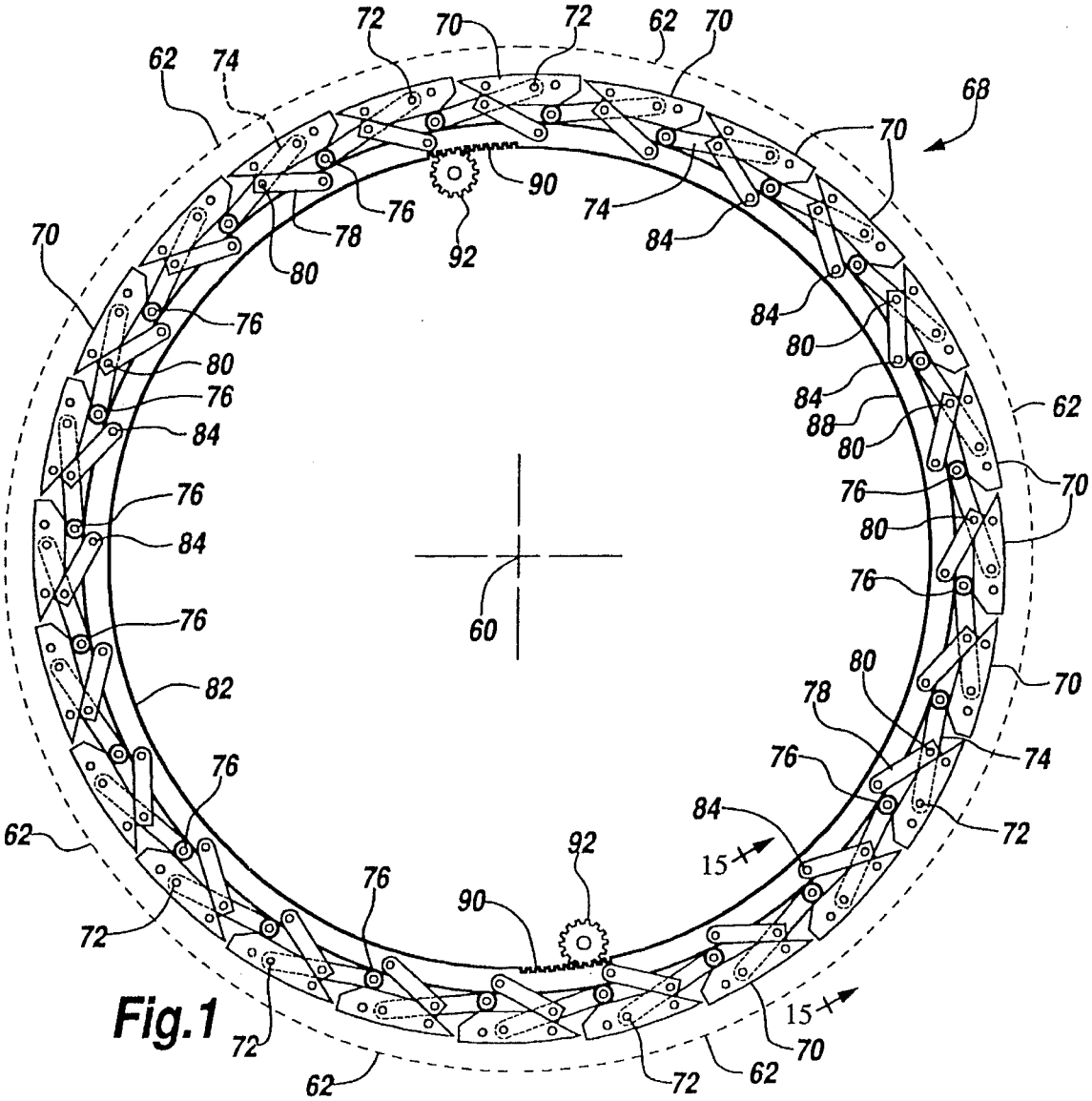
FIG. 1 is a partial cross-sectional view of the clamping mechanism taken along line 1—1 in FIG. 5 where only the clamping mechanism of the invention is shown.
Figure 8:
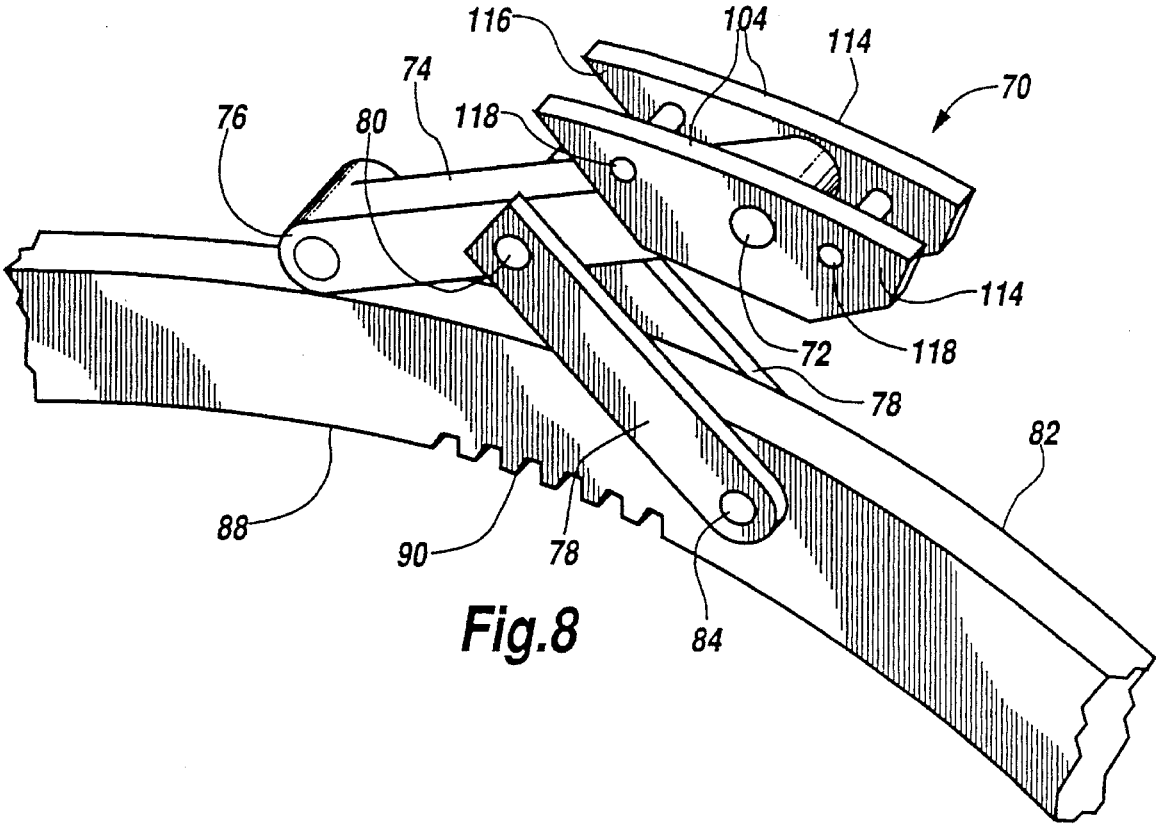
FIG. 8 is an isometric view of the clamping shoe of this invention.

The blanket shoe assembly also includes two expandable clamp assemblies 68, shown in FIGS. 1 and 5. An expandable clamp assembly 68 is connected to each end head 46 and together the assemblies releasably retain the blanket 32. Each expandable clamp assembly 68 has a plurality of clamping shoes 70. The clamping shoes 70, shown in FIG. 8, are spaced circumferentially about the axis 60 and spaced radially inwardly of the sealing surface 62 on the sealing ring 52. Each clamping shoe is pivotally mounted about a first pivot pin 72 to a main pivot link 74, which in turn is pivotally mounted by a second pivot pin 76 to the end head 46. Two jack links 78, as shown in FIG. 8, are pivotally mounted to the proximate mid-point of the main link 74 by a third pivot pin 80. A jack link is positioned on either side of the main link 74 and both jack links 78 are joined to an expansion gear ring 82 at a fourth pivot pin 84.

Figure 15:
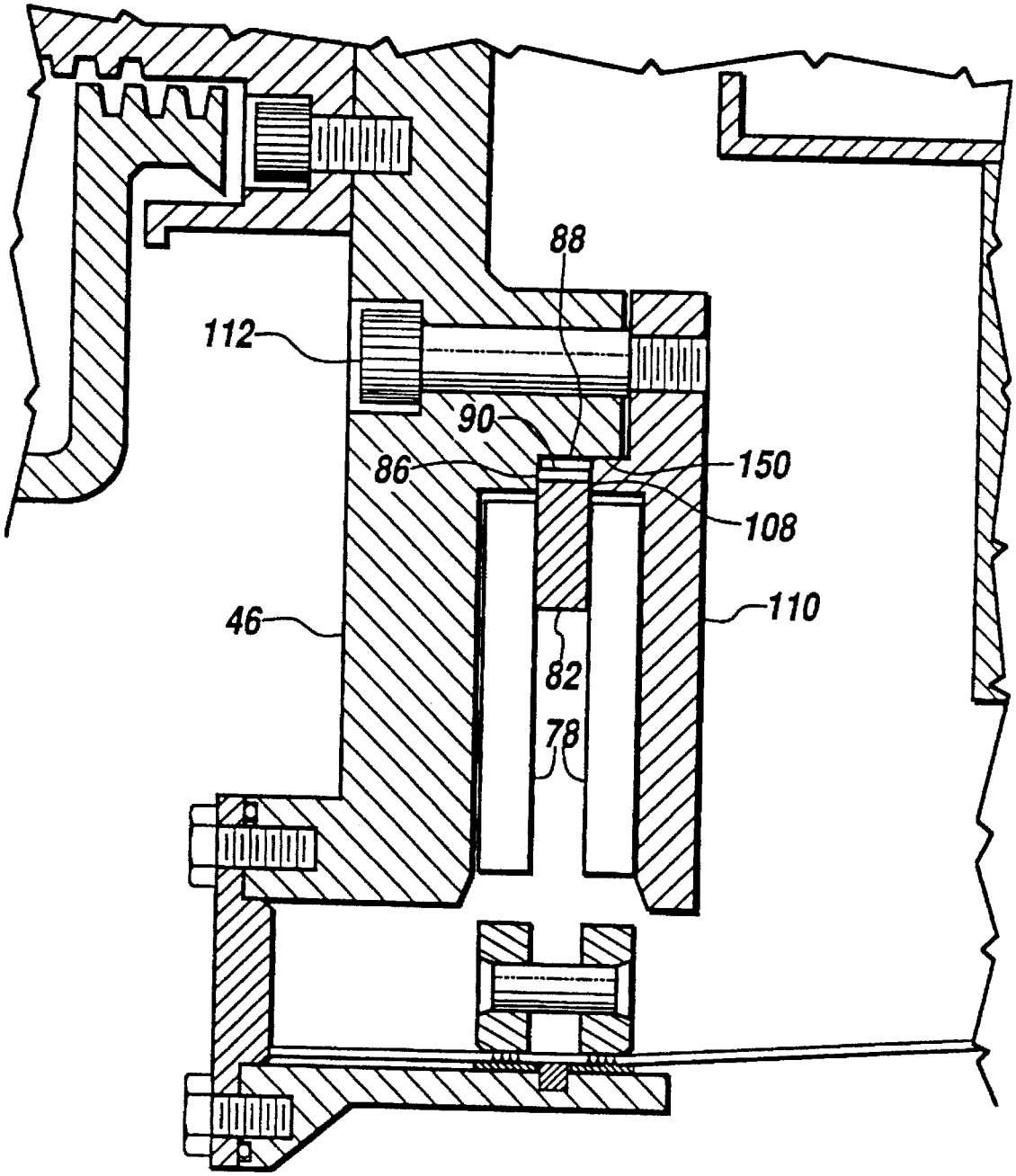
FIG. 15 is a partial cross-sectional view of a jack link taken along section line 15—15 in FIG. 1.

As shown in FIG. 15, the gear ring 82 radial inside surface 88 rides on a shoulder 150 on the head 46. The inside surface 88 of the ring has two short sections 90 of gear teeth integrally formed in the inside surface 88. As shown in FIG. 1, the gear teeth sections 90 are opposed to each other about the axis of rotation 60 and extend approximately two-and-a-half degrees along the circumference of the gear ring and are integrally formed with the gear ring. Pinion gears 92 are mounted on pinion shafts 94 which extend through bushings in the head ends 46 and beyond the head end outside surface 98. The pinion gears 92 engage the gear sections 90 of the gear ring 82, such that rotation of the two pinion gears 92 causes rotation of the gear ring with respect to the head ends 46.

Figure 4:
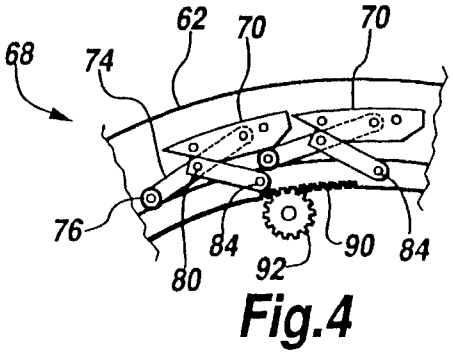
FIG. 4 is a fragmentary cross-sectional view of the clamping mechanism of FIG. 1 shown in the fully unclamped position.

The blanket 32 experiences bi-directional bending where the blanket transitions from the apple shape shown in FIG. 9 to the cylindrical clamping arrangement shown in FIG. 5. Bi-directional bending and other loads imposed on the blanket require that the blanket 32 be periodically replaced. Replacement of the blanket 32 is accomplished by removing the ring end covers 54 and the sealing ring 52 from one end of the blanket shoe assembly 64, so that the blanket 32 may readily pass over a head end 46. To release the blanket 32 the clamp assemblies 68 are adjusted to a non-clamping configuration, as shown in FIG. 4, and in the upper right fragment of FIG. 5. The ring end covers 54 are formed in four 90° sector segments comprised of two underlying segments 142 and two overlying segments 144. In installation of the blanket 32, towing clamps 102 are connected to the blanket, and mounting cables 100 are connected to the towing clamps and passed beneath the sealing ring 52, which is supported by two non-adjacent end cover segments 142. As shown in the right fragments of FIG. 5, removal of the two overlying segments 144 allows mounting cables 100 and towing clamps 102 to pass under the ring 52 when the blanket 32 is being installed.

Once the blanket's tow clamp 102 has drawn the blanket between the opposed sealing surface 62 and the shoe clamping surfaces 104, as shown in the lower right fragment of FIG. 5, the expandable clamp assemblies 68 are actuated by rotating the pinion shafts 94 by means of allen wrench sockets 106 disposed in the ends of the shafts 94. Rotation of the pinion shafts 94 causes the pinion gears 92 to rotate, which in turn causes movement of the gear teeth 90. This causes the gear ring 82 to rotate with respect to the end heads. The rotation of the gear ring 82 causes the jack links 78 to move, forcing the main links 74 to swing outwardly, as shown in FIG. 3, until the clamping shoes 70 are displaced radially outwardly to engage the inside surface 44 of the blanket 32, clamping and sealing it in place, as shown in FIG. 2.

The pinion gears can be locked in place by pinion shaft nuts 109, shown in FIG. 5. The nuts 109 clamp the pinion gears 92 against rotation. As shown in FIG. 15, the gear ring 82 is clamped between the shoulder 86 on the head end 46 and clamp surface 108 of clamp ring 110, which is held in clamping position by bolts 112 which extend through the head 46.

Figure 2:
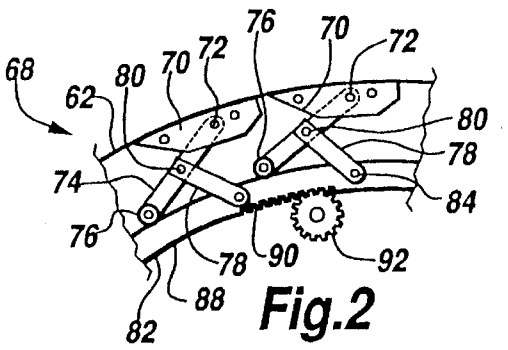
FIG. 2 is a fragmentary cross-sectional view of the clamping mechanism of FIG. 1 shown in the clamped position.
Figure 3:
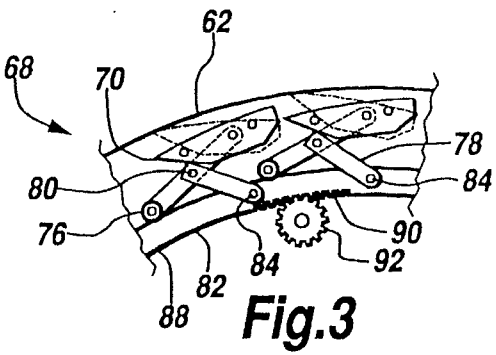
FIG. 3 is a fragmentary cross-sectional view of the clamping mechanism of FIG. 1 shown in the partially unclamped position.

The action of the gear ring 82 in combination with the jack links 78 and the main links 74 produces a cam which moves the shoes 70 outwardly, as the pinion gear causes the ring gear 82 to rotate, as illustrated in FIGS. 2–4. As shown in FIG. 8, the shoes 70 are constructed of two sides 114 separated by a central slot 116. The two sides are held together by posts 118. The shoes 70 may be constructed as an assembly or as an investment casting.

The blanket shoe assembly 64 employs internal pressurization to prevent fluttering of the blanket 32 and to lessen the flexure at the edges of the shoe 26. In a typical blanket shoe assembly 64, the internal operating pressure will be one half pound per square inch, with a start-up pressure of I psi and a maximum pressure capability of 2 psi. During start-up, when centrifugal force is not available to hold the blanket 32 in the radially outwardly extending position, greater pressure is required. When the blanket reaches operating speed, which for a blanket having a diameter of five feet, used with a web W speed of 3,000 feet per minute, the rotational speed of the blanket 32 will be approximately 191 RPM.

Even at operating speed, some internal pressure is required to overcome fluttering of the blanket 32. Flutter in the blanket 32 can be induced by changes in the web W or changes in the operating parameters of the papermaking machine. The use of internal pressure eliminates the need for internal blanket guides and reduces the possibility of internal blanket wear by interference between the blanket guides and the blanket 32.

The internal pressure and the lubricating oil require that the interior of the blanket shoe assembly 64 be sealed from the exterior. The seal must resist both oil and air.

As shown in FIG. 5, fixed baffles 120 mounted on the support beam 42 and rotating baffles 122 on the head ends 46, help prevent internal bearing lubricating oil from being deposited on the blanket 32 in the area of the bi-directional bending and prevents depositing the oil on the blanket in the area where the blanket is apple shaped. As the blanket rotates, this oil is carried on the blanket up to the nip shoe and the blanket nip where the oil is rejected from this nip and falls into a pan and is carried out of the blanket shoe assembly 46.

Loss of internal air pressure and oil is further prevented by lip seals 124 mounted on the drum head end 46 which has a wiping lip 126. Internal air pressure forces the lip against a seal surface 128 mounted on the stationary support 48. Labyrinth seals 130 combined with a drain 132 help to ensure that oil that does escape from the interior of the blanket assembly 64 is collected. Sealing the blanket 32 to the head ends 46 involves sealing the sealing surface 62 and sealing the rings 52 to the ring end covers 54. The ring end covers in turn are sealed to each other and the drum head end 46.

Figure 10:
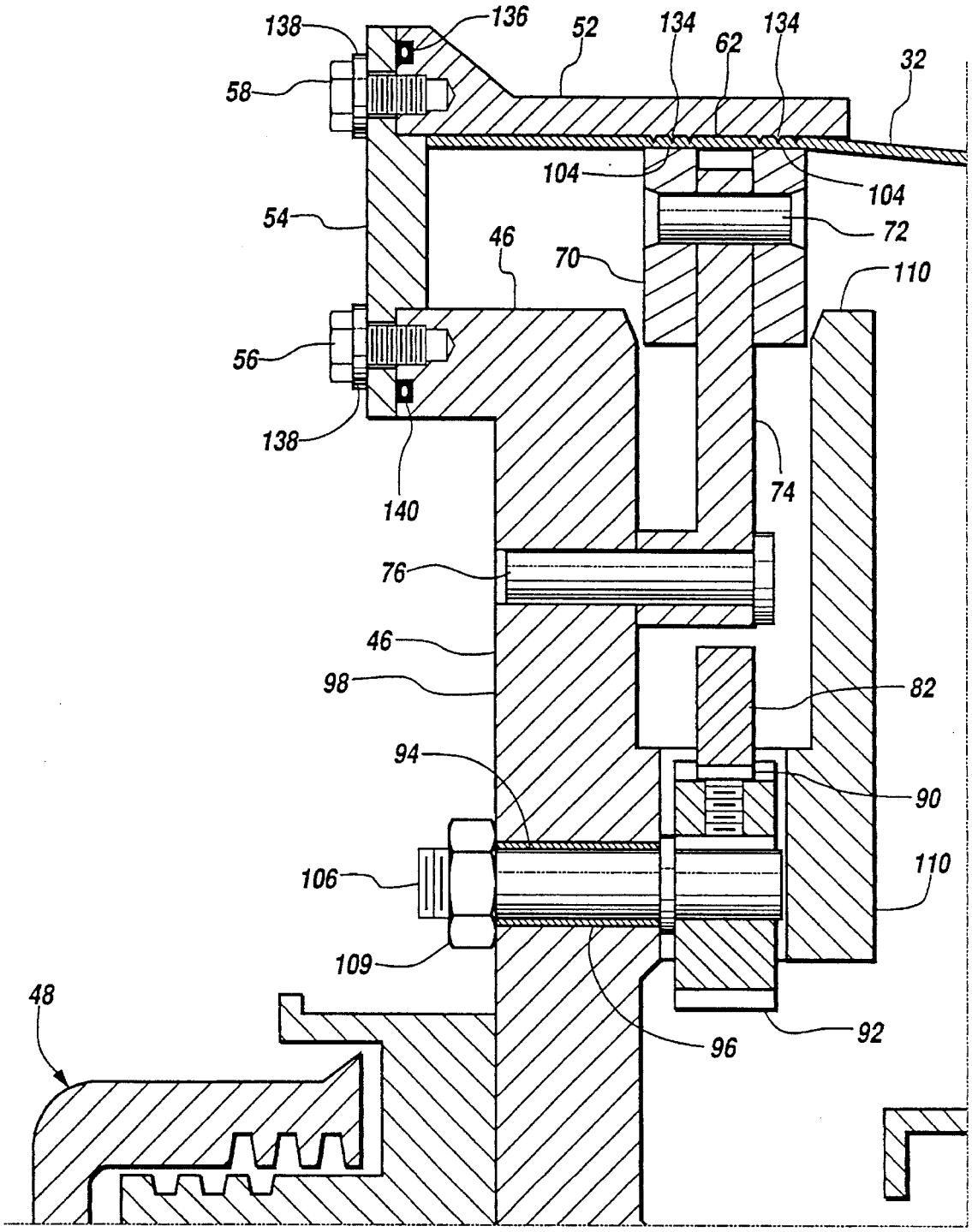
FIG. 10 is a partial cross-sectional view of an alternative blanket clamp assembly 20.

As shown in FIG. 10, the blanket 32 is forced against the sealing surface 62 by the outer surfaces 104 of the shoe 70 sides 114. Ridges 134 protrude radially inwardly from the sealing surface 62 and engage the blanket against the outer surfaces 104 of the shoe sides 114 to aid in the formation of an air- and oil-tight seal. The ring 52 is sealed by an O-ring 136 to the ring end cover 54. Sealing washers 138 beneath the bolts 56, 58 prevent leakage around the bolts 56, 58. Finally, the end cover 54 is sealed to the drum head 46 by an O-ring 140.

Figure 7:
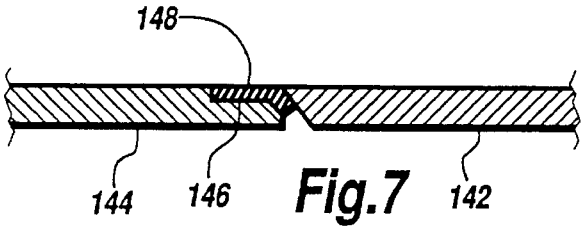
FIG. 7 is a detail cross-sectional view of the end covers of this invention taken along line 7—7 of FIG. 6.

As shown in FIG. 7, the juncture 146 between overlying segments 144 and underlying segments 142 is sealed with a neoprene gasket 148.

Figure 11:
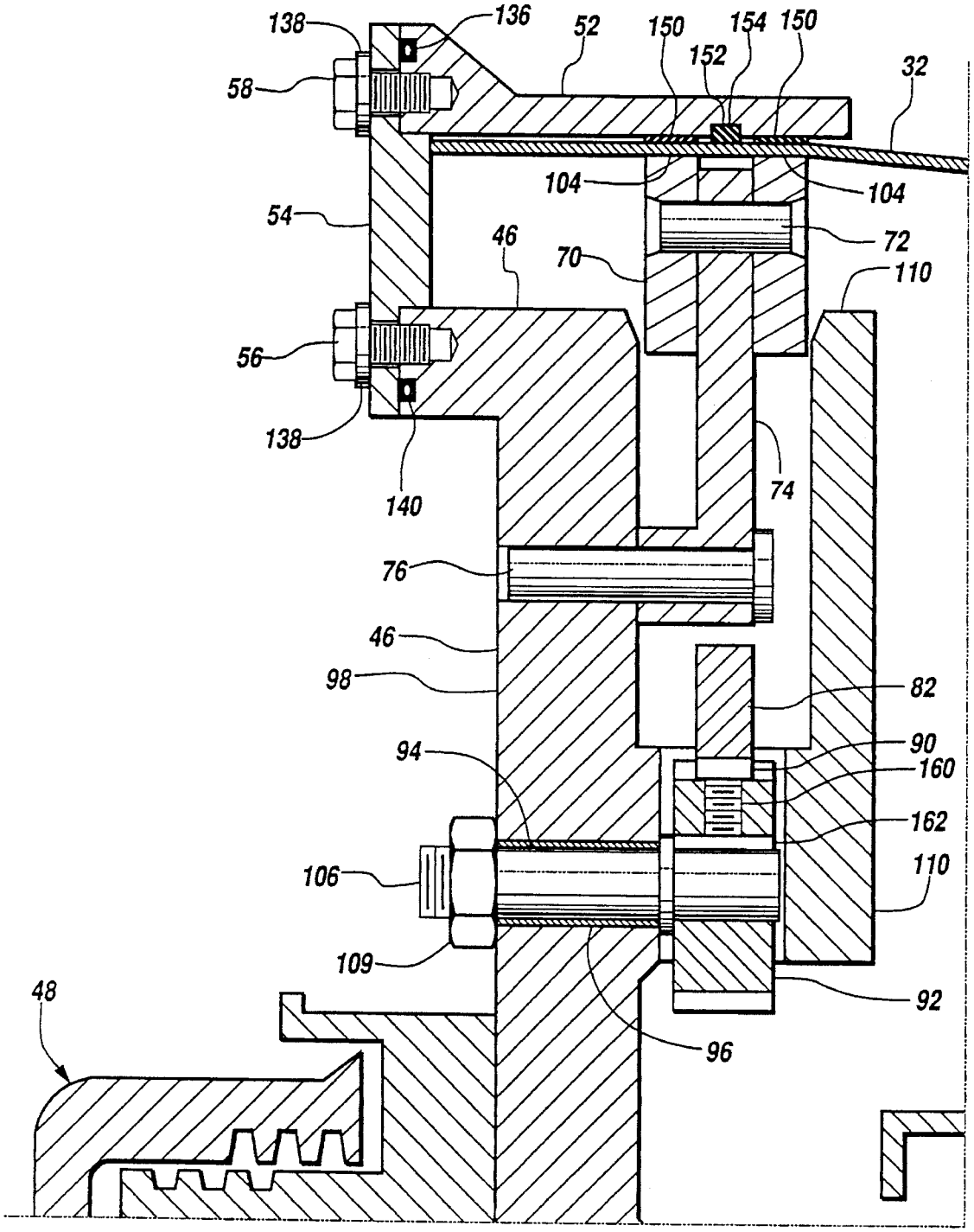
FIG. 11 is a partial cross-sectional view of another alternative blanket clamp assembly 20.

An alternative embodiment for the seal between the blanket 32 and the ring 52 is shown in FIG. 11. In the alternative arrangement, two gripper bands 150 are mounted on the sealing surface 62 of the ring 52. Spaced between the sealing bands 150 is a soft rubber air seal 152, mounted in a groove 154 formed in the ring 52. The sprocket 92 is held to the pinion shaft 94 by a setscrew 160 and a key 162.

The blanket end clamp 20 reduces machine down time by simplifying the process of pulling the blanket 32 over the non-moving shoe 26 and its support beam 42. This is accomplished by sealing the blanket 32 against an inwardly facing sealing surface 62 on removable rings 52. The expandable clamping assemblies 68 allow the blanket 32 to be clamped to the sealing surfaces 62 which are internal to the blanket shoe assembly 64 by the simple expedient of rotating one or both pinion gears 92 by means of the pinion shafts 94. The pinion shafts 94 extend through bushings 96 and are accessible from the outside of the blanket shoe assembly 64 at the outside surfaces 98 of the head ends 46.

Figure 13:
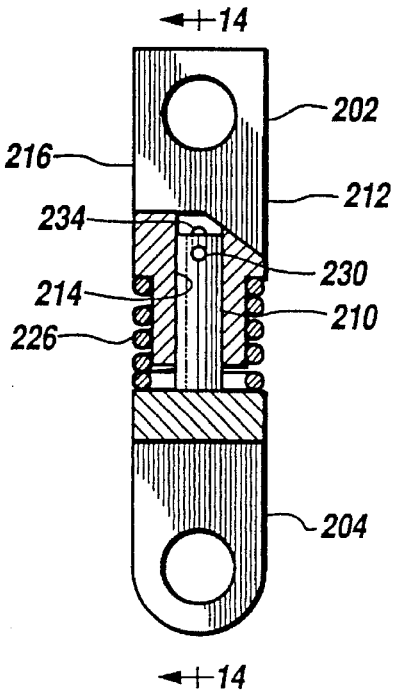
FIG. 13 is a side elevational view of a single jack link of the assembly of FIG. 12, partially broken away in section.
Figure 14:
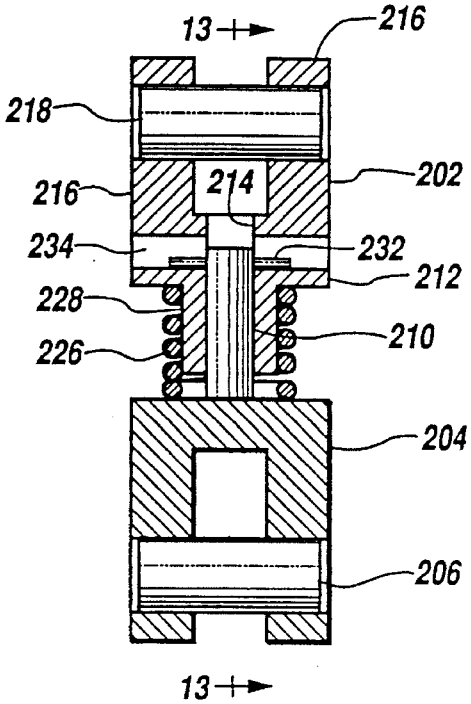
FIG. 14 is a cross-sectional view of the jack link of FIG. 13 taken along section line 14—14.
Figure 12:
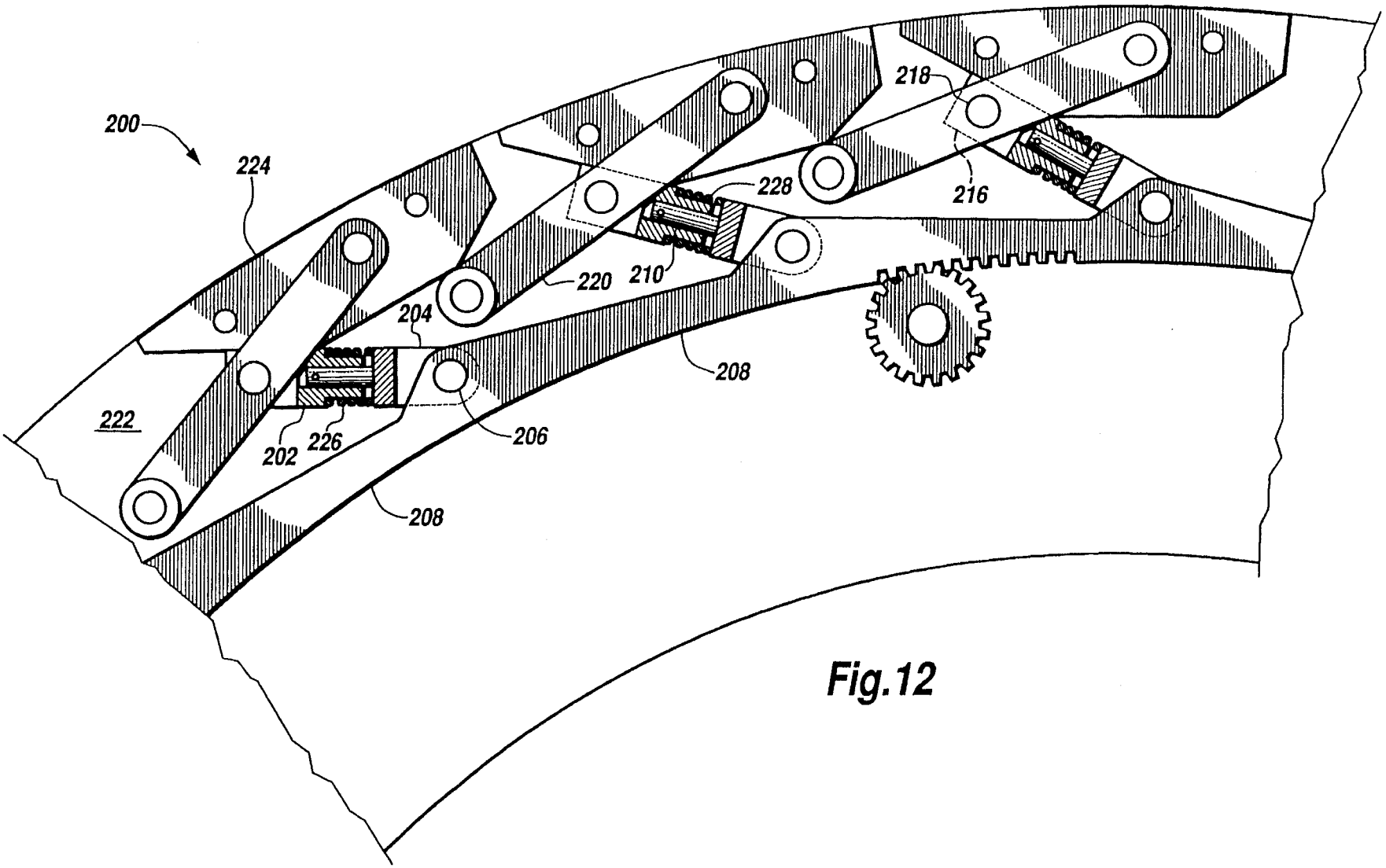
FIG. 12 is a partial cross-sectional view of an alternative blanket clamp assembly having jack links with springs to accommodate variations in link dimensions.

As shown in FIGS. 12–14, an alternative embodiment blanket end seal 200 is similar to the end seal 20, but replaces the two jacking links 78 on each main link 74 with a spring-loaded expansion jacking link 202. Each expansion jacking link 202 has a first segment 204 which is pivotably connected by a pin 206 to a gear ring 208. A shaft 210 extends radially outwardly from each first segment 204. A second expansion link segment 212 is slidably mounted to the first segment shaft 210. The second segment 212 has a cylindrical hole 214 which allows the second segment to move up and down the shaft 210, which is part of the first link segment 204. Shaft 210 has a hole 230 into which a pin 232 is inserted after the first segment 204, spring 226, and second segment 212 have been assembled. The second segment 212 has a slot 234 in which pin 232 is free to slide as the length of the expansion link assembly 202 changes. This expandable or compressible jacking link 202 provides for positive clamping of blanket 32 against removable rings 52 due to the machining tolerances of all components. Two ears 216 protrude from the second segment 212 and are connected by a pin 218 to the main link 220. The main link 220 is pivoted between the head 222 and the clamping shoe 224. A spring 226 biases the second segment 212, and hence the main link 220, away from the first segment 204. The spring 226 is preferably a coil spring which encircles a cylindrical tube 228 which is a part of the second segment 212. The spring-loaded expansion jacking links 202 ensure that the shoes are constantly kept in engagement with the blanket (not shown), even when the main links are not machined to close tolerances.

It should be understood that where the expandable clamp assembly 68 is shown, other expandable clamp assemblies could be used.

It should also be understood that the blanket end seal 20 is not limited to a particular portion of a papermaking machine but may be utilized wherever an extended nip press is required.

It is understood that the invention is not confined to the particular construction and arrangement of parts herein illustrated and described, but embraces such modified forms thereof as come within the scope of the following claims.

I claim:

1. An extended nip press apparatus for removing water from a web of paper, comprising:

a press frame;

a backing roll rotatably supported relative to the frame;

an elongated nip shoe defining a concave surface, the concave surface cooperating with the backing roll for defining therebetween an extended nip for the passage therethrough of the web;

a blanket defining an endless loop, wherein the blanket extends through the nip such that the web is disposed between the blanket and the backing roll, the blanket further defining a first and second lateral edge, the edges being spaced from one another;

two opposed heads secured to the frame, at least one of said heads being rotatably secured to the frame, each head having a sealing surface for sealing one of the blanket lateral edges against the head, the seal so formed preventing egress of lubricant disposed between the nip shoe and the blanket;

a plurality of clamping shoes having clamping surfaces thereon, wherein the clamping shoes are peripherally spaced about the axis of rotation of the at least one head and are positioned to engage the at least one head sealing surface, and wherein a blanket edge is positioned between the sealing surface and the clamping surfaces on the plurality of clamping shoes; and a cam having a link connected to each clamping shoe of the plurality of clamping shoes, such that movement of the cam causes each clamping shoe to be displaced radially outwardly to bring the clamping shoe clamping surfaces into engagement with the blanket against the at least one head sealing surface.

2. The apparatus of claim 1 wherein the link extends between the at least one head and the clamping shoe, and further comprises:

a first segment pivotably connected to the cam; and a second segment pivotably connected to the respective shoe, wherein the second segment is slidably mounted to the first segment, and wherein a spring biases the second segment away from the first segment.

3. The apparatus of claim 2 wherein the cam comprises:

a ring rotatably mounted with respect to the at least one head, wherein portions of the ring define gear teeth;

a shaft extending through the at least one head;

a pinion gear mounted to the shaft which engages the ring gear teeth in driving relation, wherein each clamping shoe link extends between the head and the clamping shoe; and a jack link extending between each link and the ring.

4. The apparatus of claim 2 wherein each clamping shoe has two radially extending and axially spaced sides, and the clamping shoe clamping surfaces are formed by radially outwardly facing portions of the clamping shoe sides, such that the blanket is engaged by the two sides of each clamping shoe.

5. The apparatus of claim 2 wherein the at least one head sealing surface is formed by a cylindrical ring which is releasably connected to the head, the ring being substantially coaxial with the at least one head.

6. The apparatus of claim 5 further comprising projections which extend radially inwardly from the cylindrical ring to engage the blanket against the clamping shoes.

7. An extended nip press apparatus for removing water from a web of paper, comprising:

two rotatable head ends each having portions defining a radially inwardly facing sealing surface;

a tubular, flexible, liquid-impervious blanket having edge portions which are secured to the head sealing surfaces;

fixed support members which support the head ends, wherein the head ends include bearings which permit rotation of the blanket and the head ends in relation to the stationary support members about an axis of rotation;

a press nip shoe mounted to the stationary support, forming with a superpositioned backing roll a pressing zone having a long nip, the blanket upon rotation being moved through the pressing zone in sliding contact with the press nip shoe;

a plurality of clamping shoes having clamping surfaces thereon, the clamping shoes being spaced about the axis of rotation of the respective head end, wherein the clamping shoes face the sealing surface, wherein the blanket edge portion is releasably engaged between the sealing surfaces of the head ends and the clamping surfaces on the plurality of clamping shoes; and a cam having a link to each of the clamping shoes, such that when the cam is moved, each clamping shoe is radially displaced with respect to the respective head end sealing surface.

8. The apparatus of claim 7 wherein the cam is a ring having a plurality of gear teeth formed thereon, and wherein a shaft is geared in driving relation to the ring, so that when the shaft is rotated, the ring rotates also.

9. The apparatus of claim 8 wherein each link comprises:

a first member with a first end pivotally fixed to the respective head end, and a second end pivotally fixed to the clamping shoes; and a second member having a first end pivotally connected to the ring and a second end pivotally connected to the first member, so that when the shaft is rotated, the ring rotates, causing the second member to pivot, which in turn causes the first member to pivot, thus moving the clamping shoe clamping surfaces toward the sealing surface.

10. The apparatus of claim 7 wherein each link is biased radially outwardly.

11. An extended nip press apparatus for removing water from a web of paper, comprising:

a press frame;

a backing roll rotatably supported relative to the frame;

an elongated nip shoe defining a concave surface, the concave surface cooperating with the backing roll for defining therebetween an extended nip for the passage therethrough of the web;

a blanket defining an endless loop, the blanket extending through the nip such that the web is disposed between the blanket and the backing roll, wherein the blanket has a first lateral edge and a second lateral edge, the edges being spaced axially from one another;

a first head and a second head rotatably mounted to the frame about an axis;

at least one pinion gear extending through the first head;

a ring gear which is coaxial with the heads and is engaged with the pinion gear, wherein at least a portion of the gear ring interior is toothed to be rotatably driven by the pinion gear;

a plurality of links pivotably connected to the first head radially outwardly of the ring gear;

a clamping shoe pivotably connected to each link radially outwardly of the ring gear;

a jack link pivotably extending between each link and the ring gear, such that rotation of the ring gear causes the radial displacement of the clamping shoes; and a clamping member fixed to the first head radially outwardly of the clamping shoes, wherein the clamping member has a radially inwardly facing concave cylindrical surface, and wherein the blanket extends between the clamping member concave surface and the plurality of clamping shoes and is releasably clamped therebetween.

12. The apparatus of claim 11 further comprising a plate spaced axially inwardly from the first head, and releasably fixed thereto, wherein the plate is releasably clampable against the gear ring to fix the positions of the clamping shoes against the blanket.

13. The apparatus of claim 11 wherein each clamping shoe has two radially extending and axially spaced sides, and clamping shoe clamping surfaces are formed by radially outwardly facing portions of the clamping shoe sides, such that the blanket is engaged by the two sides of each clamping shoe.

14. The apparatus of claim 11 further comprising projections which extend radially inwardly from the clamping member cylindrical surface to engage the blanket against the clamping shoes.

15. The apparatus of claim 11 wherein the clamping member is connected to the first head by four removable quadrant plates, such that two plates may be removed to allow the pulling of the blanket into position about the clamping shoes.

16. The apparatus of claim 11 further comprising a resilient member affixed to the clamping member cylindrical surface and extending radially inwardly to engage the blanket against the clamping shoes.

17. The apparatus of claim 11 wherein each jack link comprises:

a first segment pivotably connected to the cam; and a second segment pivotably connected to a shoe, wherein the second segment is slidably mounted to the first segment, and wherein a spring biases the second segment away from the first segment.

* * * * *

UNITED STATES PATENT AND TRADEMARK OFFICE

CERTIFICATE OF CORRECTION

PATENT NO. : 5,556,514

DATED : 9/17/96

INVENTOR(S) : James J. Didier

It is certified that error appears in the above-indentified patent and that said Letters Patent is hereby corrected as shown below:

Column 8, line 59: --respective-- was omitted after "the".

Signed and Sealed this

Eighteenth Day of March, 1997

Bruce Lehman

*Attest:*

BRUCE LEHMAN

*Attesting Officer*

*Commissioner of Patents and Trademarks*